US011883729B2

(12) United States Patent
Del Monaco et al.

(10) Patent No.: US 11,883,729 B2
(45) Date of Patent: Jan. 30, 2024

(54) DEVICES AND SYSTEM FOR PROTECTING USERS FROM A TREADMILL CONVEYOR

(71) Applicant: Technogym S.p.A., Cesena (IT)

(72) Inventors: Alessandro Del Monaco, Rimini (IT); Luca Bandini, Forli (IT); Ivan Lisi, Rimini (IT); Bernini Giulio, Longiano (IT); Dervis Pazzini, Rimini (IT); Massimiliano Casoni, Cesena (IT)

(73) Assignee: Technogym S.p.A., Forlì-Cesena (IT)

( * ) Notice: Subject to any disclaimer, the term of this patent is extended or adjusted under 35 U.S.C. 154(b) by 163 days.

(21) Appl. No.: 17/380,903

(22) Filed: Jul. 20, 2021

(65) Prior Publication Data

US 2022/0362652 A1 Nov. 17, 2022

Related U.S. Application Data

(60) Provisional application No. 63/187,764, filed on May 12, 2021.

(51) Int. Cl.

| | |
|---|---|
| ***A63B 71/00*** | (2006.01) |
| ***A63B 22/02*** | (2006.01) |
| ***A63B 24/00*** | (2006.01) |

(52) U.S. Cl.

CPC ..... *A63B 71/0054* (2013.01); *A63B 22/0235* (2013.01); *A63B 24/0087* (2013.01); *A63B 2024/0093* (2013.01); *A63B 2071/009* (2013.01); *A63B 2071/0081* (2013.01); *A63B 2220/13* (2013.01); *A63B 2220/833* (2013.01)

(58) Field of Classification Search

CPC ..... A63B 71/0054; A63B 22/0235; A63B 2220/13; A63B 22/0207; A63B 2208/12; A63B 2071/0081; A63B 2220/833; A63B 2071/009; Y10T 403/7015

See application file for complete search history.

(56) References Cited

U.S. PATENT DOCUMENTS

| | | | |
|---|---|---|---|
| 4,720,789 | A | 1/1988 | Hector et al. |
| 4,906,193 | A | 3/1990 | McMullen et al. |
| 4,927,136 | A | 5/1990 | Leask |

(Continued)

FOREIGN PATENT DOCUMENTS

| | | | |
|---|---|---|---|
| CN | 201316497 | Y | 9/2009 |
| CN | 207323943 | U | 5/2018 |

(Continued)

OTHER PUBLICATIONS

Steinhage et al., "Monitoring Movement Behavior by means of a Large Area Proximity Sensor Array in the Floor", <https://www.researchgate.net/publication/221562066_Monitoring_Movement_Behavior_by_Means_of_a_Large_Area_Proximity_Sensor_Array_in_the_Floor>, Jan. 2008, 14 pages.

(Continued)

*Primary Examiner* — Megan Anderson
*Assistant Examiner* — Sara K. Conway
(74) *Attorney, Agent, or Firm* — Carr & Ferrell LLP

(57) ABSTRACT

A protective cover and system for detecting objects within or near an entrapment area on a treadmill or devices that incorporate a conveyor belt. A controller enables the treadmill to operate normally when no objects are detected within or near an entrapment area and is designed to stop the conveyor when an object is detected within or near the entrapment area.

20 Claims, 12 Drawing Sheets

(56) References Cited

U.S. PATENT DOCUMENTS

| | | | | |
|---|---|---|---|---|
| 5,163,885 | A * | 11/1992 | Wanzer | A63B 22/02 482/54 |
| 5,314,391 | A | 5/1994 | Potash et al. | |
| 5,368,532 | A | 11/1994 | Farnet | |
| 5,382,207 | A | 1/1995 | Skowronski et al. | |
| 5,800,314 | A | 9/1998 | Sakakibara et al. | |
| 5,820,525 | A | 10/1998 | Riley | |
| 5,857,939 | A | 1/1999 | Kaufman | |
| 5,897,461 | A * | 4/1999 | Socwell | A63B 22/02 482/54 |
| 6,053,844 | A | 4/2000 | Clem | |
| 6,122,846 | A | 9/2000 | Gray et al. | |
| 6,231,527 | B1 | 5/2001 | Sol | |
| 6,438,255 | B1 | 8/2002 | Lesniak | |
| 6,860,839 | B1 | 3/2005 | Dice et al. | |
| 7,101,319 | B1 | 9/2006 | Potts | |
| 7,258,651 | B2 | 8/2007 | Clarke | |
| 7,507,187 | B2 | 3/2009 | Dyer et al. | |
| 7,572,206 | B2 | 8/2009 | Wilkins et al. | |
| 7,890,235 | B2 | 2/2011 | Self et al. | |
| 7,914,420 | B2 | 3/2011 | Daly et al. | |
| 8,652,051 | B2 | 2/2014 | Twery | |
| 11,577,121 | B2 * | 2/2023 | Hsu | A63B 22/0235 |
| 2004/0106503 | A1 * | 6/2004 | Wu | A63B 22/0257 482/54 |
| 2005/0009668 | A1 | 1/2005 | Savettiere et al. | |
| 2005/0100871 | A1 | 5/2005 | Parker et al. | |
| 2007/0247320 | A1 | 10/2007 | Morahan | |
| 2007/0255186 | A1 | 11/2007 | Grill | |
| 2007/0275830 | A1 | 11/2007 | Lee et al. | |
| 2008/0242511 | A1 | 10/2008 | Munoz et al. | |
| 2009/0036272 | A1 | 2/2009 | Yoo | |
| 2009/0135001 | A1 | 5/2009 | Yuk | |
| 2016/0213976 | A1 * | 7/2016 | So | A63B 71/0622 |
| 2018/0250552 | A1 | 9/2018 | Liao et al. | |
| 2022/0355179 | A1 * | 11/2022 | Nguyen | G01S 13/88 |

FOREIGN PATENT DOCUMENTS

| | | | |
|---|---|---|---|
| CN | 212662556 | U | 3/2021 |
| GB | 2415919 | A | 1/2006 |
| WO | WO1998036400 | A1 | 8/1998 |
| WO | WO2004099966 | A1 | 11/2004 |
| WO | WO2008062572 | A1 | 5/2008 |

OTHER PUBLICATIONS

Rangarajan et al., "The Design of a Pressure Sensing Floor for Movement-based Human Computer Interaction", <URL:https://www.researchgate.net/profile/Assegid-Kidane/publication/221255256_The_Design_of_a_Pressure_Sensing_Floor_for_Movement-Based_Human_Computer_Interaction/links/54789c930cf205d1687f774a/The-Design-of-a-Pressure-Sensing-Floor-for-Movement-Based-Human-Computer-Interaction.pdf>, Nov. 28, 20214, 18 pages.

* cited by examiner

DEVICES AND SYSTEM FOR PROTECTING USERS FROM A TREADMILL CONVEYOR

CROSS-REFERENCE TO RELATED APPLICATIONS

This application claims the benefit and priority of U.S. Provisional Application Ser. No. 63/187,764, filed on May 12, 2021, which is hereby incorporated by reference herein as if fully set forth herein, for all purposes.

FIELD OF THE PRESENT TECHNOLOGY

The present disclosure pertains to devices and methods for protecting users from a conveyor of a treadmill or other similar device, as well as preventing users from being injured by the conveyor.

BACKGROUND

The safety of a treadmill is a very important aspect. The conveyor a user trains on, when in motion, can represent a hazard in the event that an object or an individual (such as a child) comes into contact with the conveyor.

This aspect is even more accentuated in the case in which the conveyor is not a continuous surface but a so-called roller shutter belt in which the various strips placed side-by-side have a distance that in the bending phase is accentuated even more with the increase of the possibilities that objects or even the fingers of a hand, especially the smaller ones of a child, can be accidentally inserted between the strips.

Therefore, there is a need to devise and provide a treadmill which at least partially obviates the drawbacks mentioned above with reference to the known art, and increases safety in order to prevent users from injuries.

SUMMARY

In some embodiments, the present disclosure is directed to a treadmill that comprises a conveyor supported on a frame, the conveyor having an open end creating an entrapping area; and a protective cover that is installed on the open end of the conveyor of the treadmill and cover the open end and prevent an object from entering the entrapping area.

In some embodiments, the treadmill further comprises a sensor associated with the treadmill or the protective cover, the sensor detecting when an object is near or within the entrapping area between the protective cover and the conveyor of the treadmill, and a controller configured to receive signals from the sensor, the controller allowing the conveyor to freely operate when no objects are sensed within the entrapping area and stopping the conveyor when an object is sensed within the entrapping area.

In some embodiments, the present disclosure is directed to a system or apparatus comprising a protective cover for a treadmill; a first sensor element associated with the protective cover; a second sensor element associated with a side cover of the treadmill; and a controller configured to receive signals from the first sensor element and the first sensor element, the controller allowing a conveyor of the treadmill to freely operate when the signals from the first sensor element and the second sensor element indicate that the protective cover is closed, and stopping the conveyor when the signals from the first sensor element and the second sensor element indicate that the protective cover is open.

In some embodiments, the present disclosure is directed to a system or apparatus comprising an arcuate body for a treadmill; a first armature extending from the arcuate body; a second armature extending from the arcuate body in parallel with the first armature; a first coupling interface on a terminal end of the first armature; and a second coupling interface on a terminal end of the second armature, the first coupling interface and the second coupling interface being associated with legacy brackets of a frame of the treadmill.

BRIEF DESCRIPTION OF THE DRAWINGS

A detailed description is set forth regarding the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
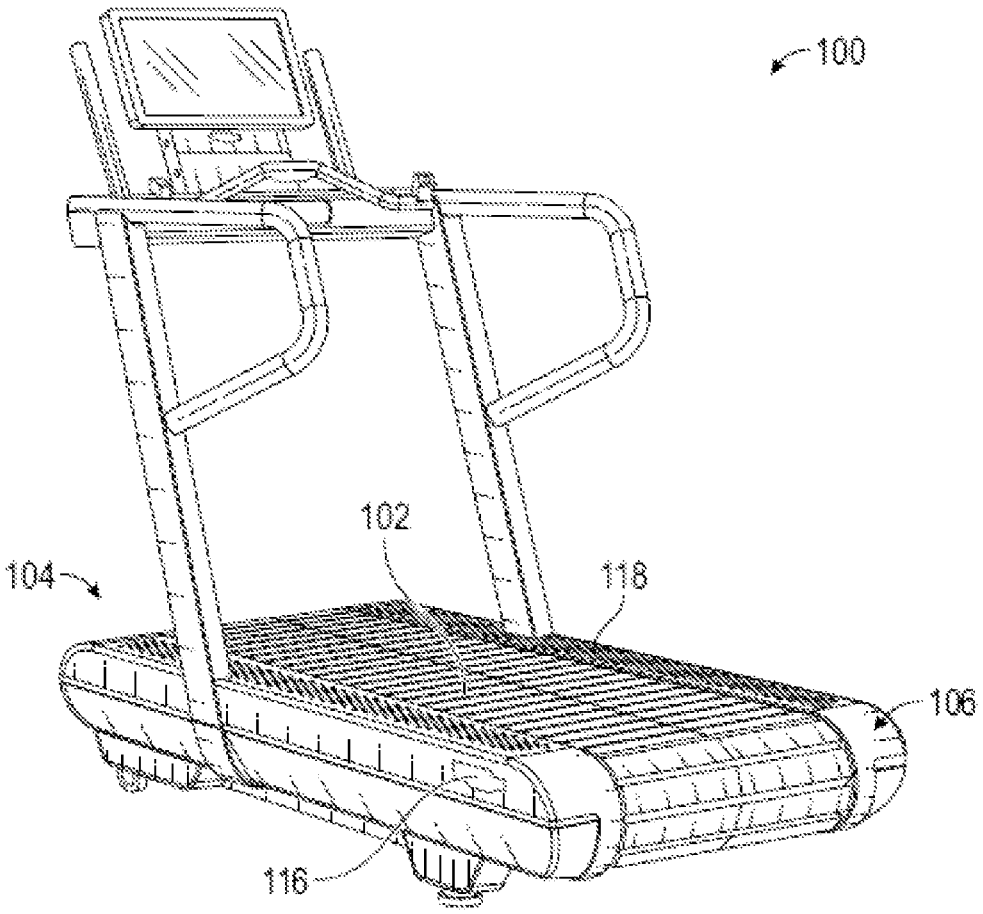
PRIOR ART FIG. 1
FIG. 1 illustrates an example prior art treadmill.

Generally, the present disclosure pertains to devices that can be used to guard a treadmill conveyor to reduce a likelihood of user injury or death. To be sure, a treadmill includes a conveyor such as a belt or continuous tread track that rotates inside a frame. A user can walk or run on the conveyor. However, some treadmills have conveyors with exposed terminal ends. For example, the treadmill 100 of FIG. 1 has a conveyor 102 inside a frame 104. A user can have an appendage, such as a foot or leg, pulled under the treadmill 100 by the conveyor 102. A small child can be pulled under and may be seriously injured or die. In the example illustrated in FIG. 1, both the front and rear ends of the conveyor 102 are exposed, however, an exposed end (rear end) 106 of the conveyor 102 poses the highest risk to users. To be sure, FIG. 1 illustrates a prior art treadmill and reference numerals in the 100s refer to this prior art treadmill.

The treadmill 100 comprises legacy brackets 108 and 110. The legacy brackets are identical to one another, with one being configured for left-handed use and one for right-handed use. For example, the legacy bracket 108 comprises a square tubular body 112 having a j-shaped pin 114. In some embodiments, the treadmill 100 comprises side covers 116 and 118 that enclose the edges of the conveyor 102.

FIGS. 2-17 collectively illustrate the treadmill 100 with various versions of protective covers. In some instances, the treadmill is augmented with sensors to detect the position of a protective cover. In another embodiment, the treadmill is augmented with sensors to detect the presence of objects in proximity to the protective cover, or between the protective cover and the conveyor of the treadmill.

FIGS. 2-9 collectively illustrate the treadmill 100 with an example protective cover 202 that can be used to cover the exposed end 106 of a conveyor 102 of the treadmill 100 to protect a user from injury. The protective cover 202 comprises an arcuate body 208 that can be secured to an underside of the frame 104 of the treadmill 100. Any suitable mechanism for affixing the protective cover 202 to the frame 104 can be utilized. However, in one example embodiment, the protective cover 202 comprises two armatures 214 and 216 that extend from the arcuate body 208. Each of the armatures 214 and 216 are associated with a coupling interface that can connect to legacy brackets 108 and 110 of the treadmill 100. For example, a first coupling interface 218 can connect to the legacy bracket 108, while a second coupling interface 220 can connect to the legacy bracket 110.

Figure 2:
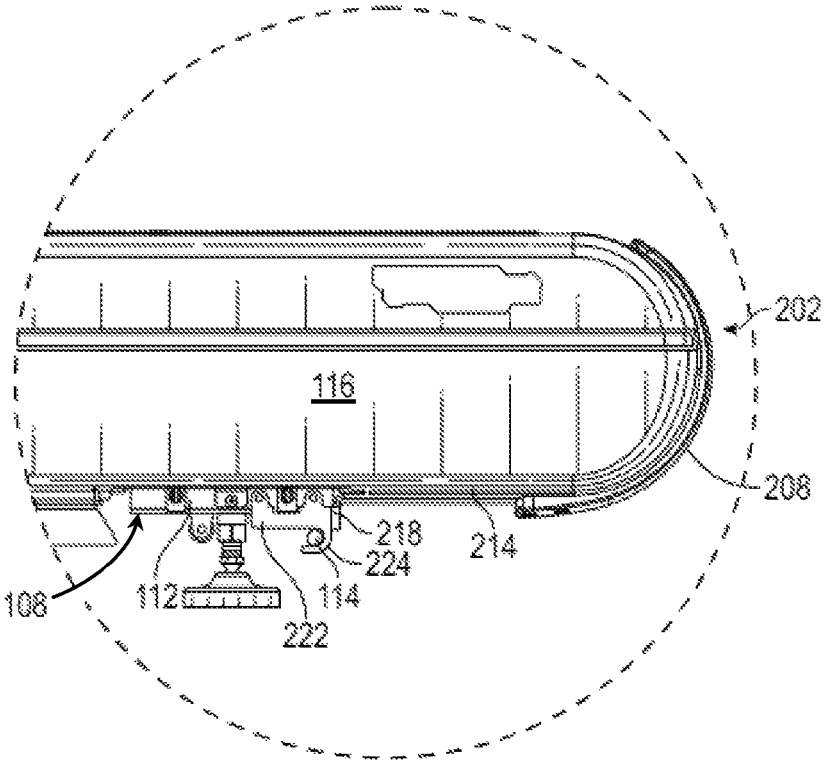
FIG. 2 is a partial elevation view of a treadmill in combination with a protective cover.
Figure 3:
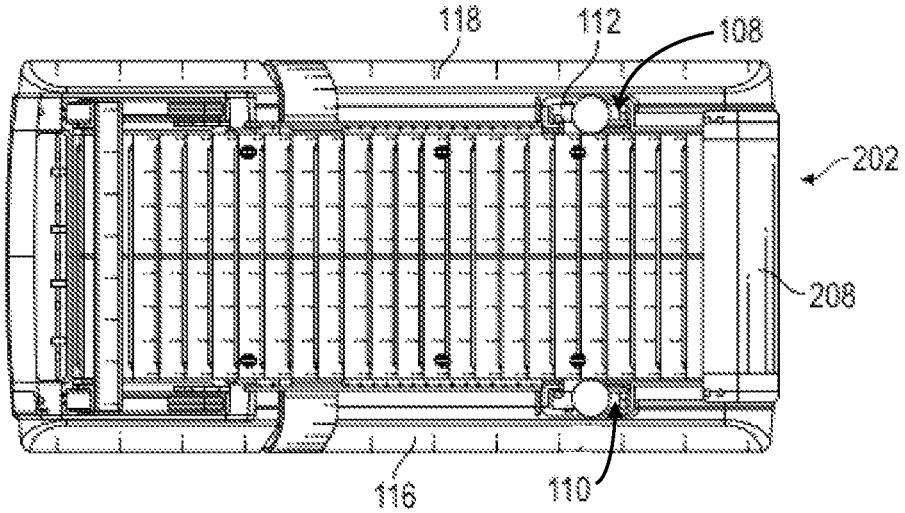
FIG. 3 is a bottom plan view of the treadmill in combination with the protective cover.
Figure 4:
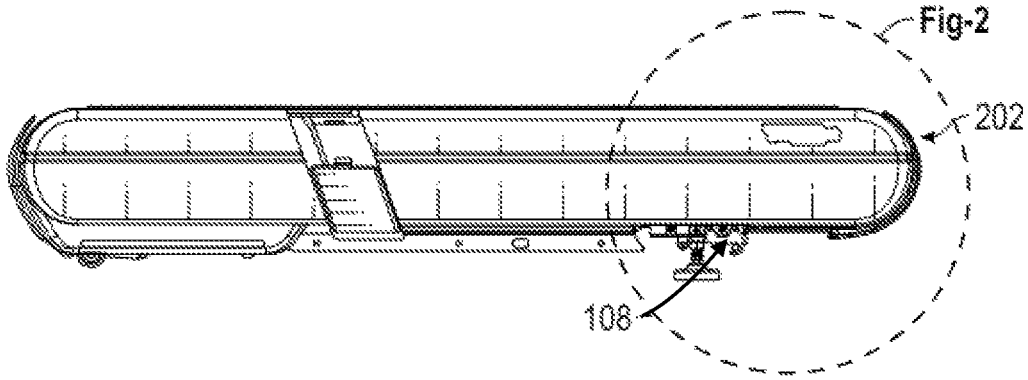
FIG. 4 is an elevation view of a treadmill in combination with the protective cover.
Figure 5:
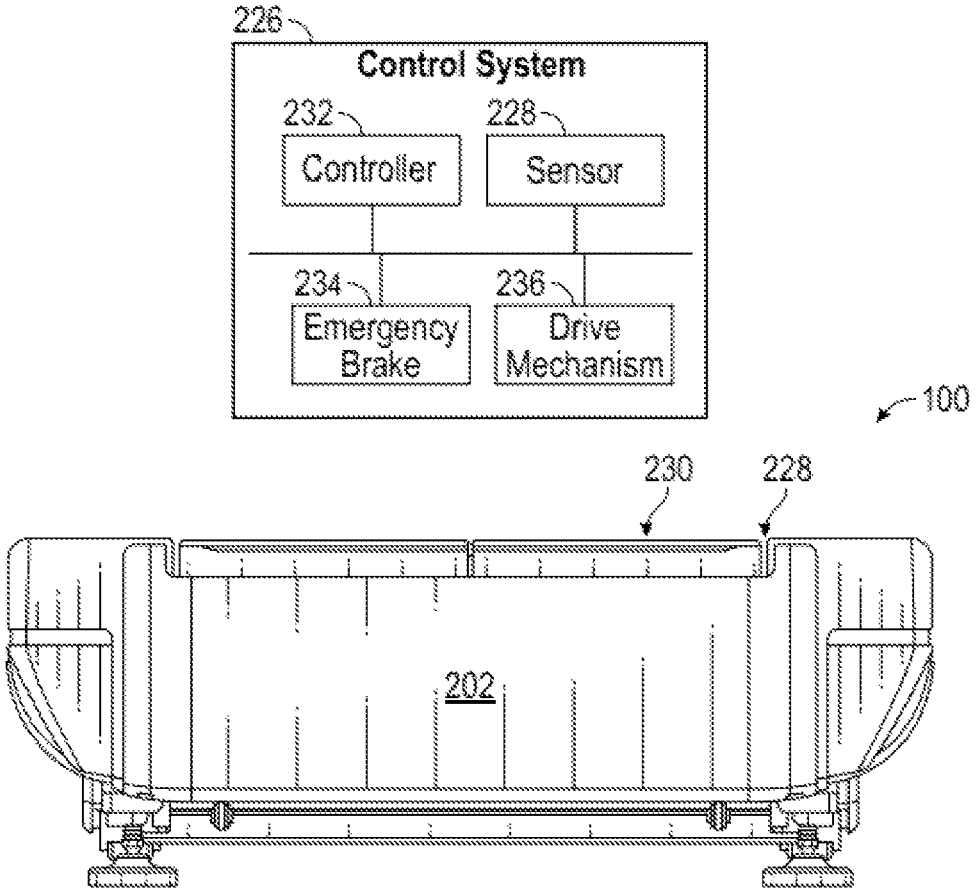
FIG. 5 is an elevation view of an end of the treadmill in combination with the protective cover.
Figure 6:
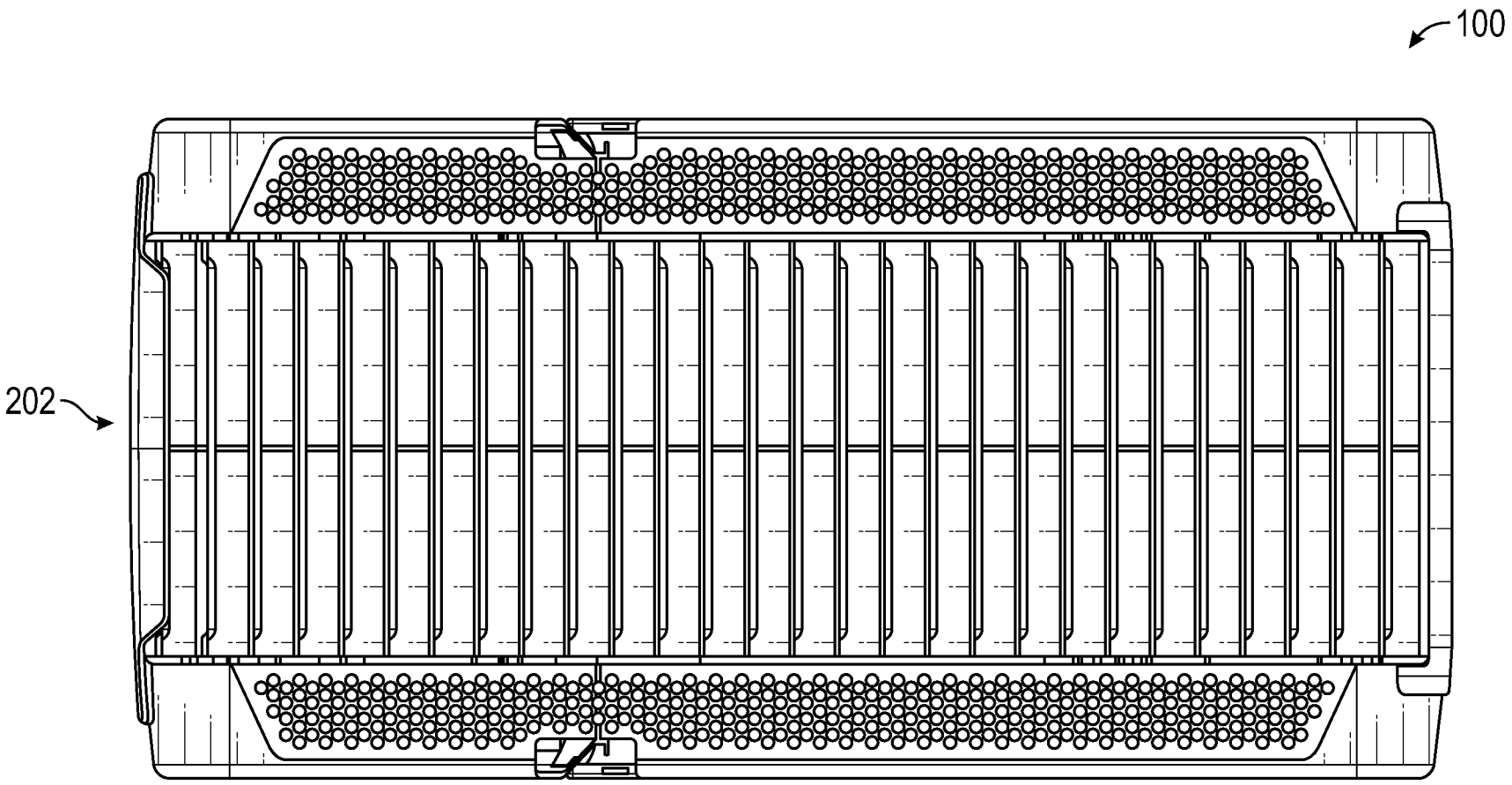
FIG. 6 is a bottom plan view of the treadmill in combination with the protective cover.
Figure 7:
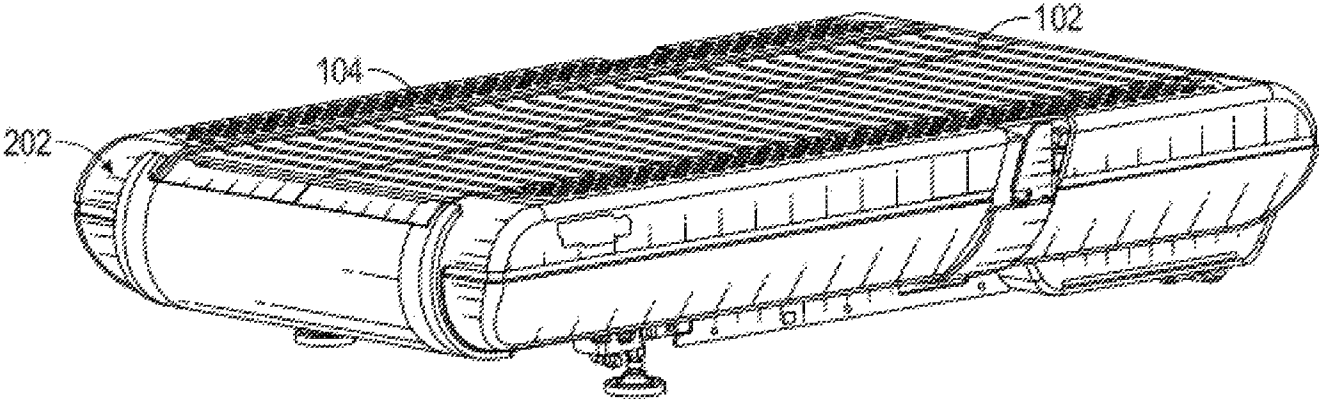
FIG. 7 is a perspective view of the treadmill in combination with the protective cover.
Figure 8:
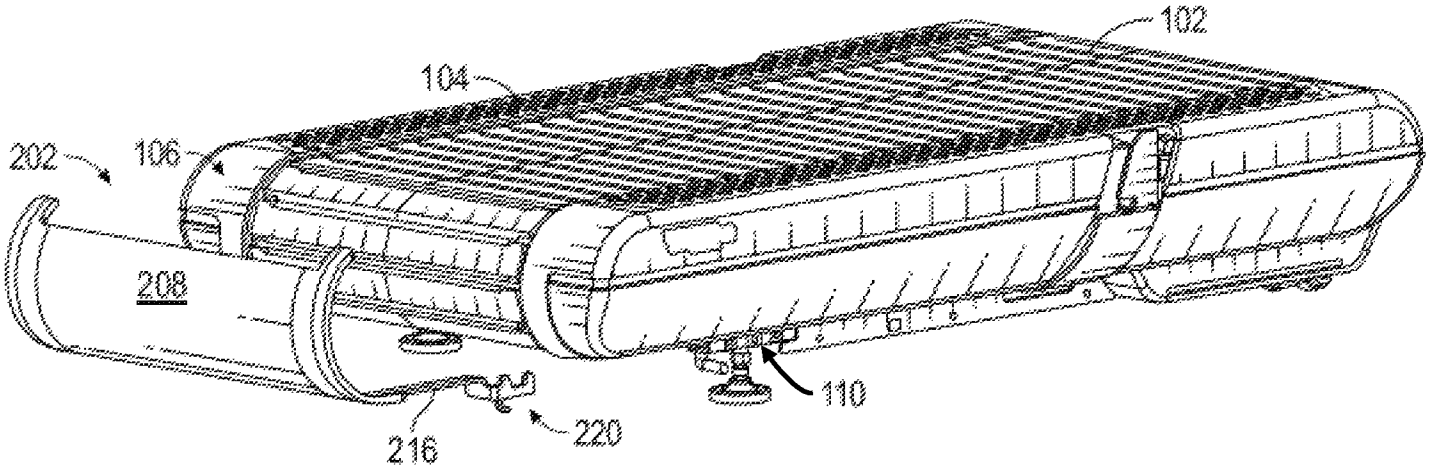
FIG. 8 is an exploded perspective view of the treadmill in combination with the protective cover.
Figure 9:
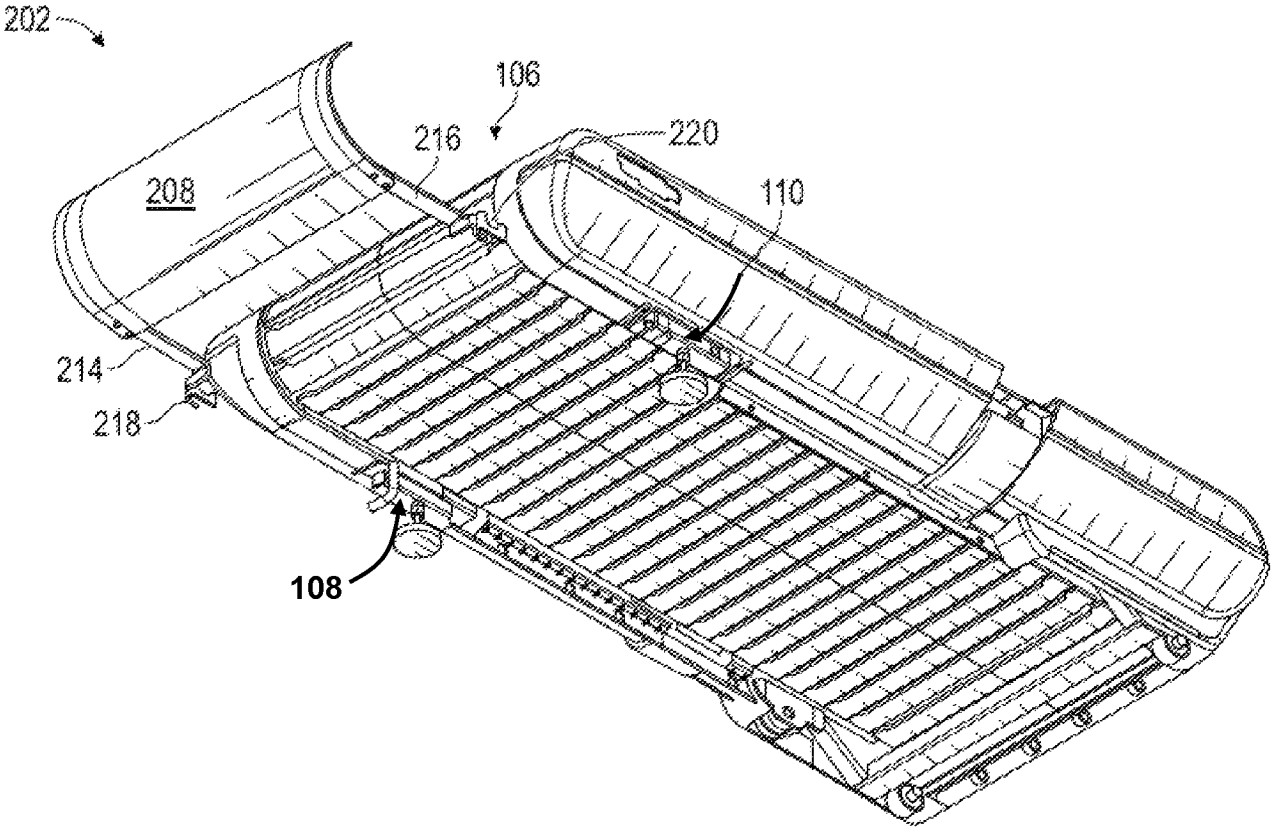
FIG. 9 is an exploded perspective view of the underside of treadmill in combination with the protective cover.

A closeup view of the first coupling interface 218 is illustrated in FIG. 2, in combination or installed on the legacy bracket 108. The first coupling interface 218 includes a coupler body 222 that mates with the legacy bracket 108. The coupler body 222 can be affixed to the legacy brackets 108 with one or more fasteners. The coupler body 222 comprises a hook portion 224 that engages with the j-shaped pin 114 of the legacy bracket 108.

The arcuate body 208 extends below an underside of the frame 104, around the exposed end 106, and above to an upper side of the frame 104. In some instances, the protective cover 202 is sized to overlap opposing side covers 116 and 118 of the treadmill 100. A small gap can be present between the protective cover 202 and the conveyor 102 to allow the conveyor 102 to freely rotate in a protected manner.

In some embodiments, the protective cover 202 can be used without the inclusion of the guard sensor. Indeed, any of the protective covers disclosed herein can be used without an accompanying sensor or control mechanisms related to the conveyor of the treadmill.

In some instances, a control system 226 can be included. The control system 226 can include a sensor 228 located near an entrapping area 230. The entrapping area 230 is an area between the protective cover 202 and conveyor 102. When an object is detected near or inside this entrapping area 230 the sensor 228 causes the disengagement of a drive mechanism 236, by shutting off the power supply of the drive mechanism 236. The drive mechanism 236 can be a motor. As a consequence, the conveyor 102 stops and the entrapped object can be removed. In alternative or in combination, the sensor 228 may activate an emergency device, such as a brake 234, and the conveyor stops. The control system 226 can also include a controller 232 to obtain sensor output and control operation of the conveyor in response thereto. The controller 232 can receive signals from the sensor 228 that indicate the presence (or lack thereof) of an object in the entrapping area 230.

The controller 232 can cause the conveyor 102 to stop turning when an object is detected in the entrapping area. When an object is detected near or inside this entrapping area 230 the sensor 228 sends a related signal to the controller 232 that causes the disengagement of the drive mechanism 236. In details, the controller shuts off the power supply to the drive mechanism 236, such as a motor. As a consequence, the conveyor 102 stops and the entrapped object can be removed. In alternative or in combination, the sensor 228 may cause the controller 232 to activate an emergency brake 234 that can be applied to the conveyor 102. The controller 232 can include all or a portion of the components of the example computer system of FIG. 17. Portions of the control system 226, such as the sensor and controller, can be integrated into legacy components of the treadmill 100, or in some instances retrofit. The controller 232 could include a legacy controller of the treadmill that has been reprogrammed to perform the functions disclosed herein.

The controller 232 can cause a display (not shown) of the treadmill to emit a visual and/or acoustic warning when the conveyor is active and the protective cover 202 is in the open position. For example, an audible, natural language warning can be emitted by a speaker associated with the treadmill. In another example, the audible warning could be a tone or other audible sound pattern.

The above embodiment may also comprise a force or pressure sensor (for example an accelerometer, a load cell, or equivalent) that, if engaged, stops the conveyor 102 from moving (or stops a motor or other drive mechanism of the conveyor 102 through braking or termination of power). The sensor can be electrically connected (either directly or indirectly) to an emergency device (such as a brake) of the treadmill. Any object contacting (such as bumping) into the protective cover 202, is sensed by the force or pressure sensor and causes an emergency device (through use of the controller 232) of the conveyor 102 to activate and prevent the conveyor from turning. In some embodiments, the protective cover 202 can incorporate any of the sensor(s) disclosed herein for detecting protective cover closing/opening, and/or presence of objects between the conveyor 102 and protective cover 202. The sensor(s) can communicate with a controller that controls when the conveyor 102 is active or stopped.

Figure 10:
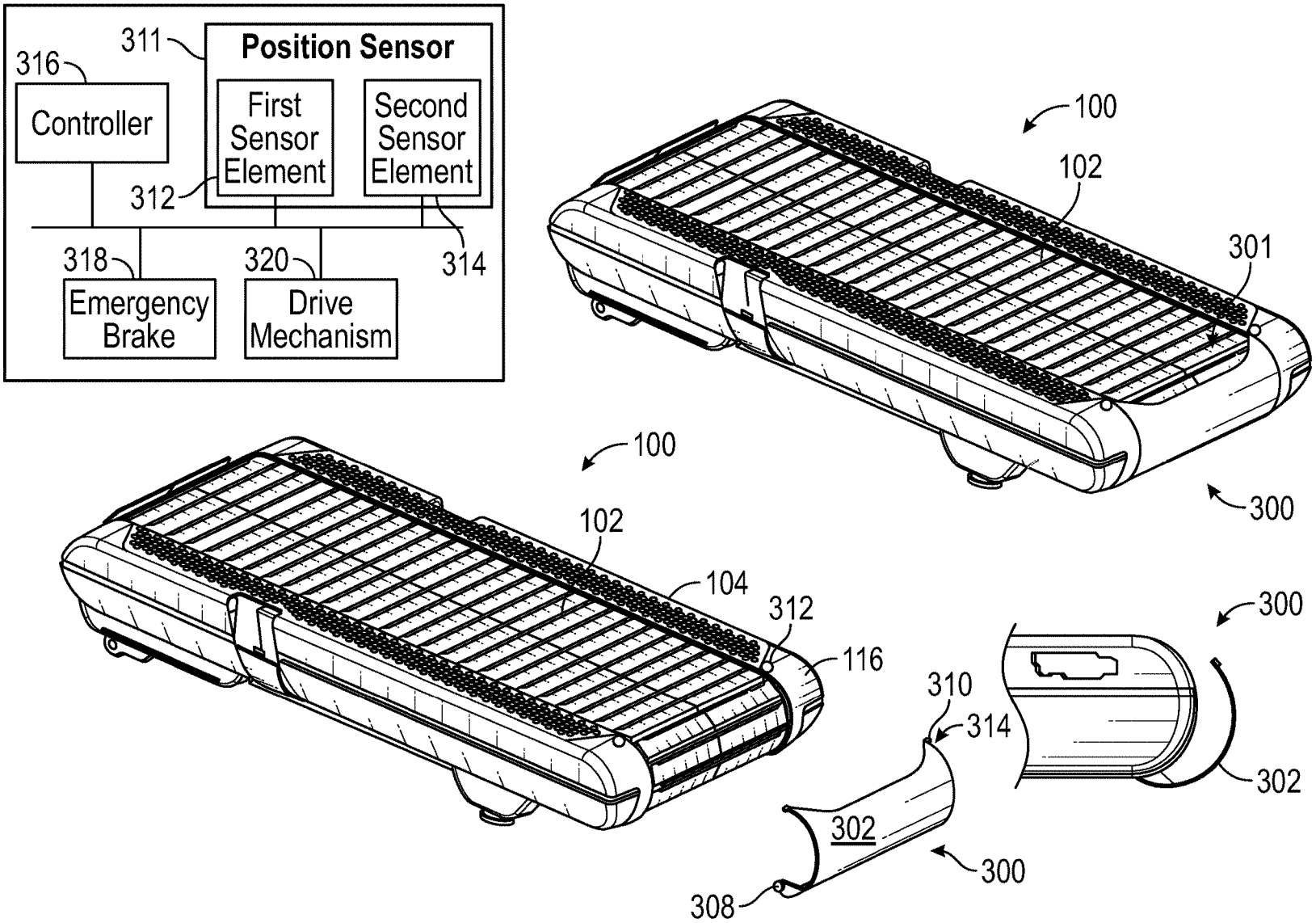
FIG. 10 is a perspective view of another example protective cover in combination with a treadmill. A partial close-up view of the protective cover is also illustrated.
Figure 11:
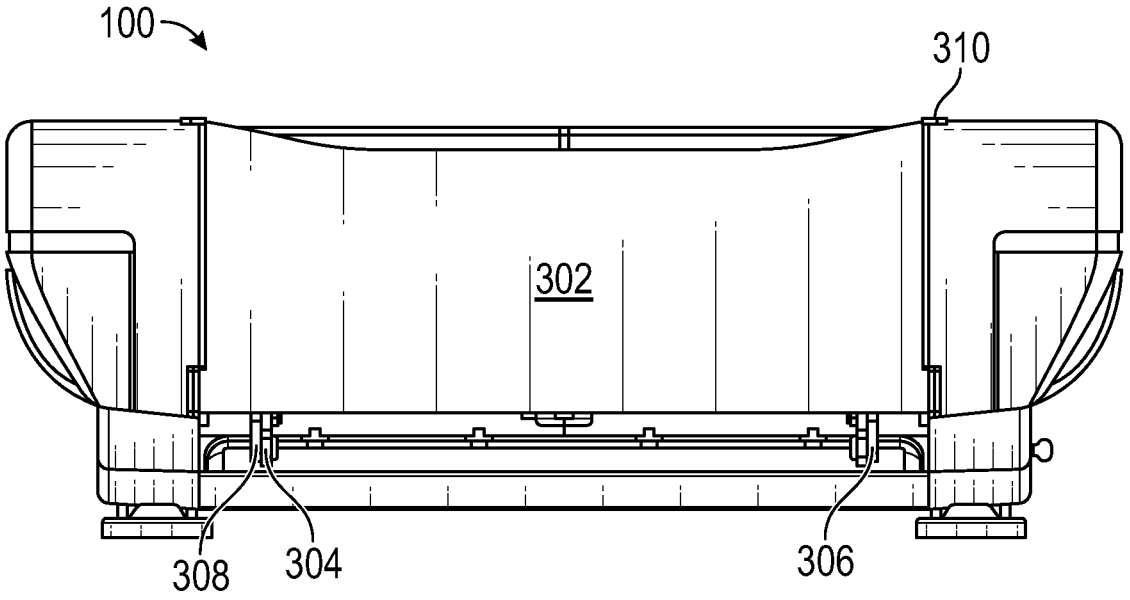
FIG. 11 is an elevation view of an end of the treadmill in combination with the protective cover.
Figure 12:
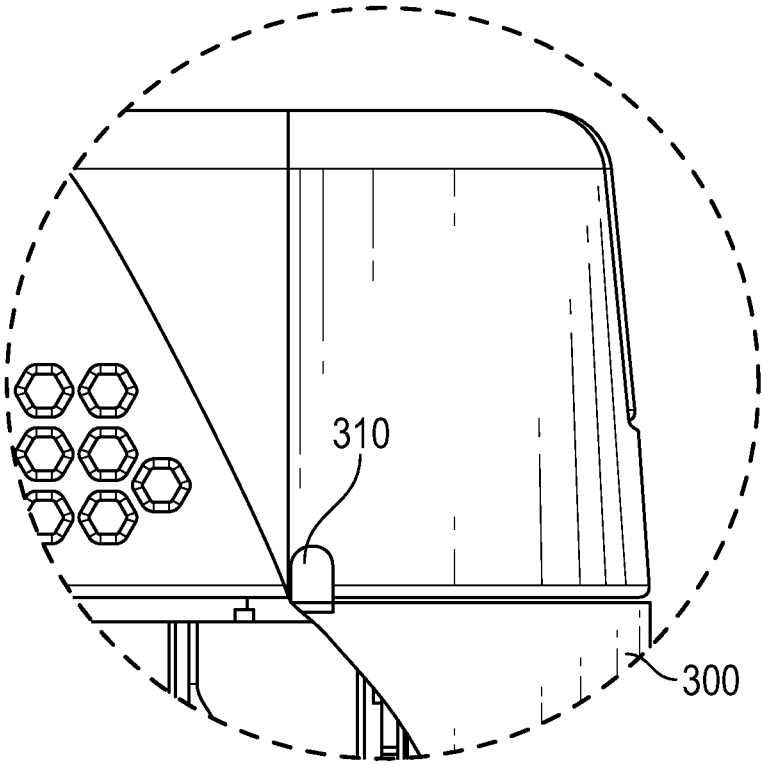
FIG. 12 is a close-up view of the protective cover in a closed configuration on the treadmill.

FIGS. 10-12 illustrate another example embodiment of a protective cover 300 that can be pivotally associated with the frame 104 of the treadmill 100. The protective cover 300 has an arcuate body 302 that is similar in shape to the protective cover 202 above. The protective cover 300 can comprise two brackets 304 and 306 that can be installed on an underside of the frame 104 of the treadmill 100. The arcuate body 302 includes hinge tabs or protrusions, such as protrusion 308, that can engage with the bracket 304, allowing the arcuate body 302 to hinge open and closed.

Thus, the arcuate body can be hingedly coupled to a frame or other portion of the treadmill using brackets installed on the treadmill.

Another protrusion (not shown) attaches another side of the arcuate body 302 to the bracket 306. The protective cover 300 can also include tabs, such as tab 310 that can engage with a side cover of the treadmill 100. The tab 310 can be resiliently biased to snap onto and off of the side cover.

The above embodiment may be improved and made safer by applying switch/contact sensors. The tab 310 can be removably connected to the side cover. The tab can comprise one sensor (for example magnetic sensor or other equivalent), with a complementary sensor being located on the side cover or frame of the treadmill.

The protective cover 300 is hinged into a closed position when the contact sensors of the tabs come into contact with the respective two side covers of the treadmill 100, where the protective cover 300 is placed into a closed and covered relationship with the frame. The contact can include magnetic and/or electrical contact. When the contact sensors mate, an electrical and/or magnetic signal can be detected.

If an object should come into proximity with the covered rear end of the treadmill, such as an object dragged back by the conveyor, such object may slip between the protective cover 300 and the conveyor causing the protective cover 300 to open. The area between the protective cover 300 and conveyor 102 is referred to as an entrapping area 301.

As a result, contact between the contact sensors of the tabs and the side cover is interrupted, which causes the conveyor to stop turning. For example, a controller can be communicatively coupled to the contact sensor and may detect this break or interruption in contact and cause a motor or other drive mechanism that operates the conveyor to stop or may cause the termination of power of the drive mechanism or motor. The controller can alternatively activate an emergency brake associated with the conveyor. If any objects should get close and/or reach the rear portion of the treadmill, the protective cover 300 provides protection to prevent any such objects from being carried underneath the treadmill by the conveyor. In some instances, objects may still enter between the protective cover and the conveyor of the treadmill. Systems and methods for detecting and remediating these events are described herein as well.

In one embodiment, a position sensor 311 can be included with the protective cover 300. The position sensor 311 includes a first sensor element 312 and a second sensor element 314. The first sensor element 312 can be integrated into a side cover 116 of the treadmill 100. The second sensor element 314 can be placed onto an underside of the tab 310 of the protective cover 300. When the protective cover is placed into a closed configuration as in FIGS. 11 and 12, the first sensor element 312 mates with the second sensor element 314 to create a connection therebetween. This connection may be electrical, magnetic, or the like. When the first sensor element 312 mates (e.g., brought into face-to-face relationship, and may or may not be physically contacting depending on the type of sensor) with the second sensor element 314, a signal is received by a controller 316 that indicates that the protective cover is closed. When closed, the conveyor is allowed to freely rotate. When the first sensor element 312 is not in a mating relationship with the second sensor element 314, a signal is received by a controller 316 that indicates that the protective cover is open. The controller 316 can cause the conveyor 102 to stop turning when the protective cover is open. This can include the engagement of an emergency brake 318 that can be applied to the conveyor 102. In alternative or in combination, this can also involve removing power from a drive mechanism 320 of the conveyor 102 such as a motor. Another pair of sensor elements can be associated with the other tab of the protective cover 300. The controller 316 can include all or a portion of the components of the example computer system of FIG. 17.

As with other embodiments, the controller 316 can cause a display (not shown) of the treadmill to emit a visual and/or acoustic warning when the conveyor is active and the protective cover 300 is in the open position. For example, an audible, natural language warning can be emitted by a speaker associated with the treadmill. In another example, the audible warning could be a tone or other audible sound pattern.

Figure 13:
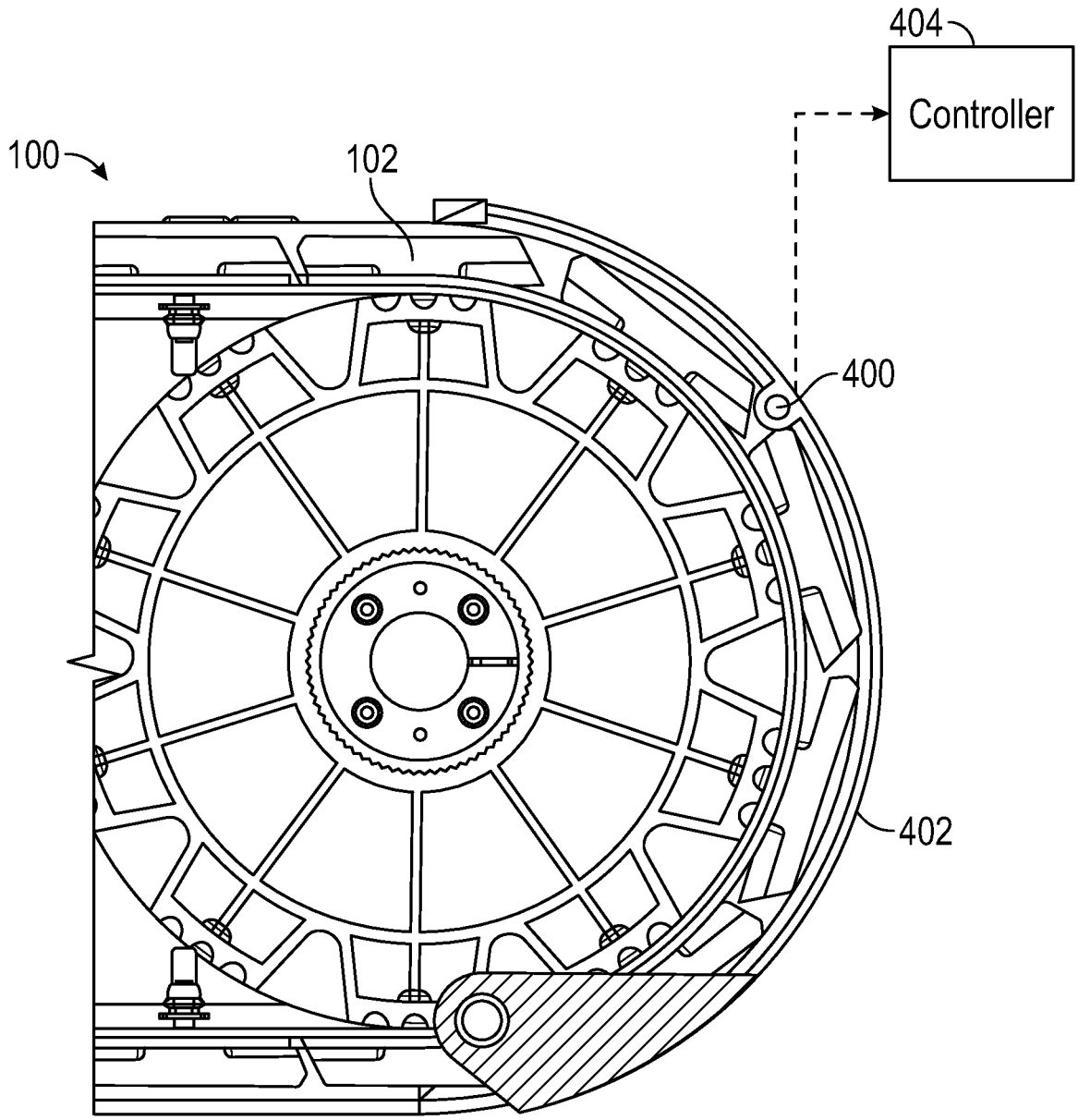
FIG. 13 is a cross-sectional view of the protective cover in a closed configuration on the treadmill.

FIG. 13 illustrates another example position sensor 400 that can be configured to determine when a protective cover 402 is open or closed. The protective cover 402 can hinge open or closed similarly to the protective cover 300 of FIGS. 10-12. The position sensor 400 can detect a distance between the position sensor 400 and the conveyor 102 of the treadmill 100. The position sensor 400 can be mounted on the protective cover 402 and/or the frame of the treadmill 100. The position sensor 400 can output a signal to a controller 404 that indicates whether the protective cover 402 is open or closed. The position sensor 400 can also detect the hinged movement of the protective cover 402 rather than, or in addition to, distance. Another example sensor could include a contact sensor that detect when two objects are in physical contact. For example, the sensor may detect when the protective cover 402 contacts a portion of the frame of the treadmill. The controller 404 can be coupled to the sensor 400 in a wired or wireless manner. The controller 404 can include all or a portion of the components of the example computer system of FIG. 17. The controller 404 can cause a display (not shown) of the treadmill to emit a visual and/or acoustic warning when the conveyor is active and the protective cover 402 is in the open position. For example, an audible, natural language warning can be emitted by a speaker associated with the treadmill. In another example, the audible warning could be a tone or other audible sound pattern. Alternatively, the controller 404 can prevent the conveyor from being activated when the protective cover 402 is in the open position. The conveyor cannot turn until the position sensor 400 senses that the protective cover 402 is closed.

Figure 14:
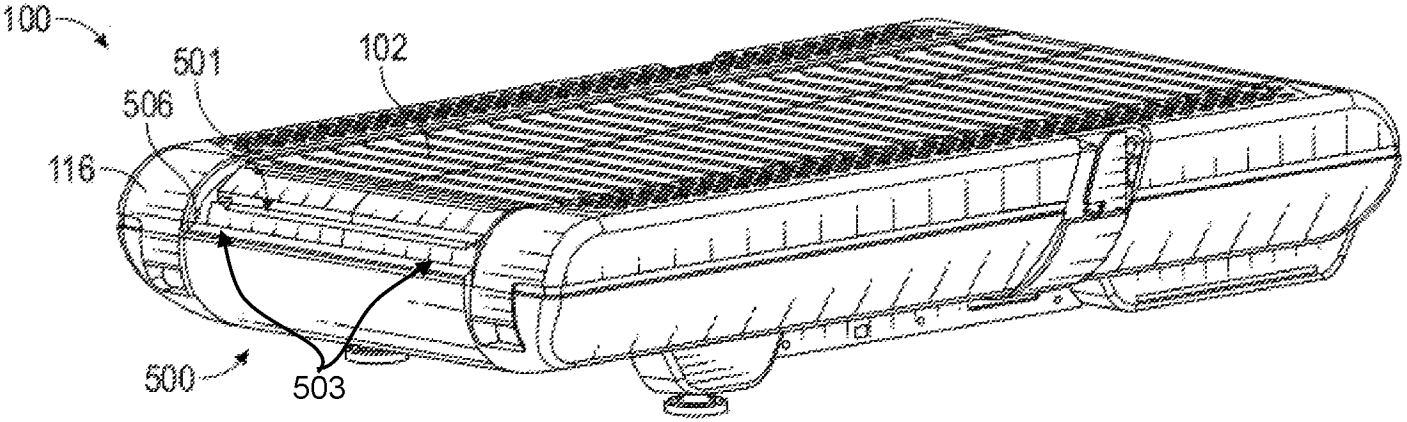
FIG. 14 is a perspective view of an example protective cover in combination with a treadmill.
Figure 15:
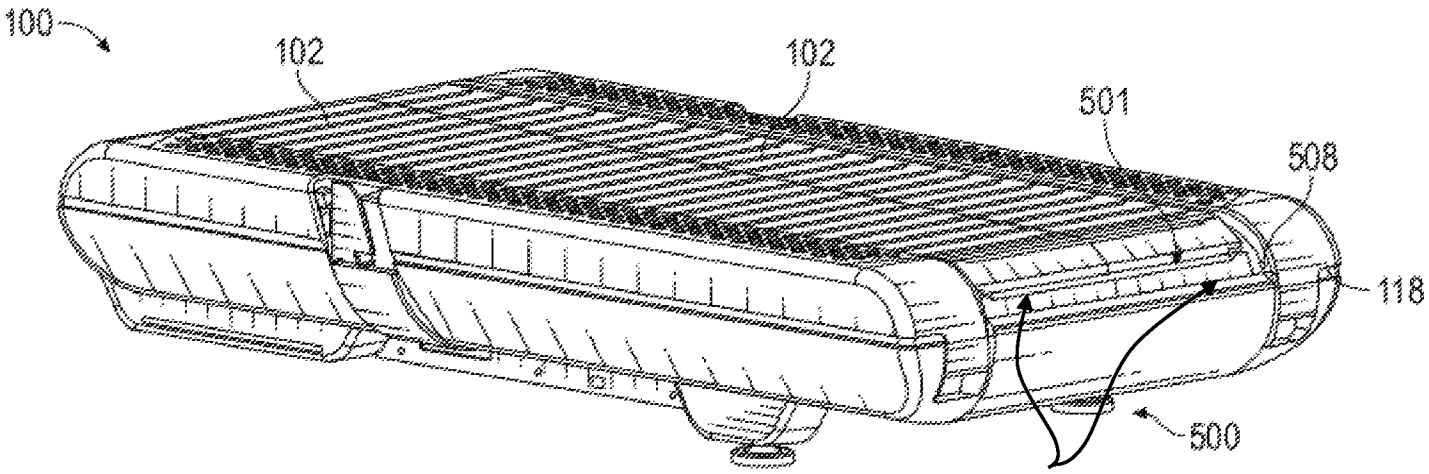
FIG. 15 is another perspective view of the example protective cover in combination with the treadmill.
Figure 16:
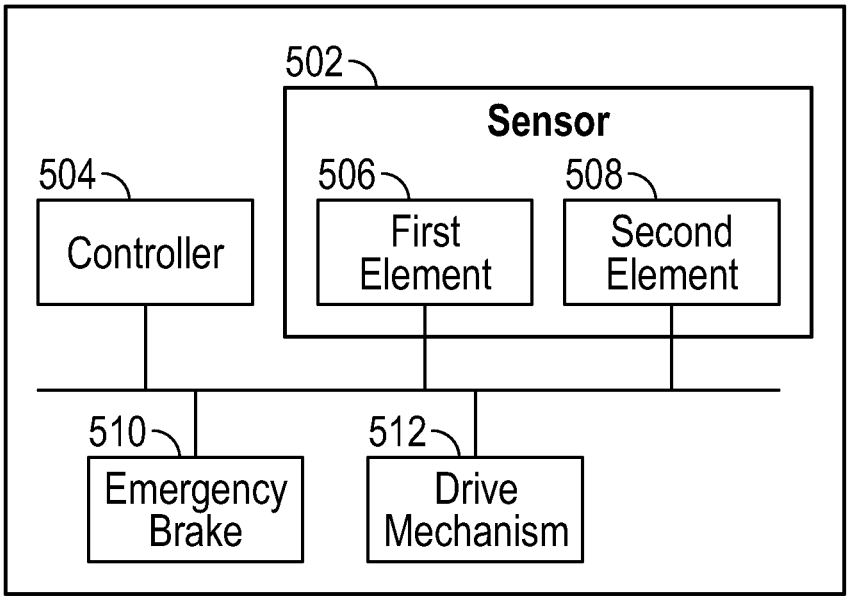
FIG. 16 is a cross-sectional view of the protective cover in a closed configuration on the treadmill.
Figure 16:
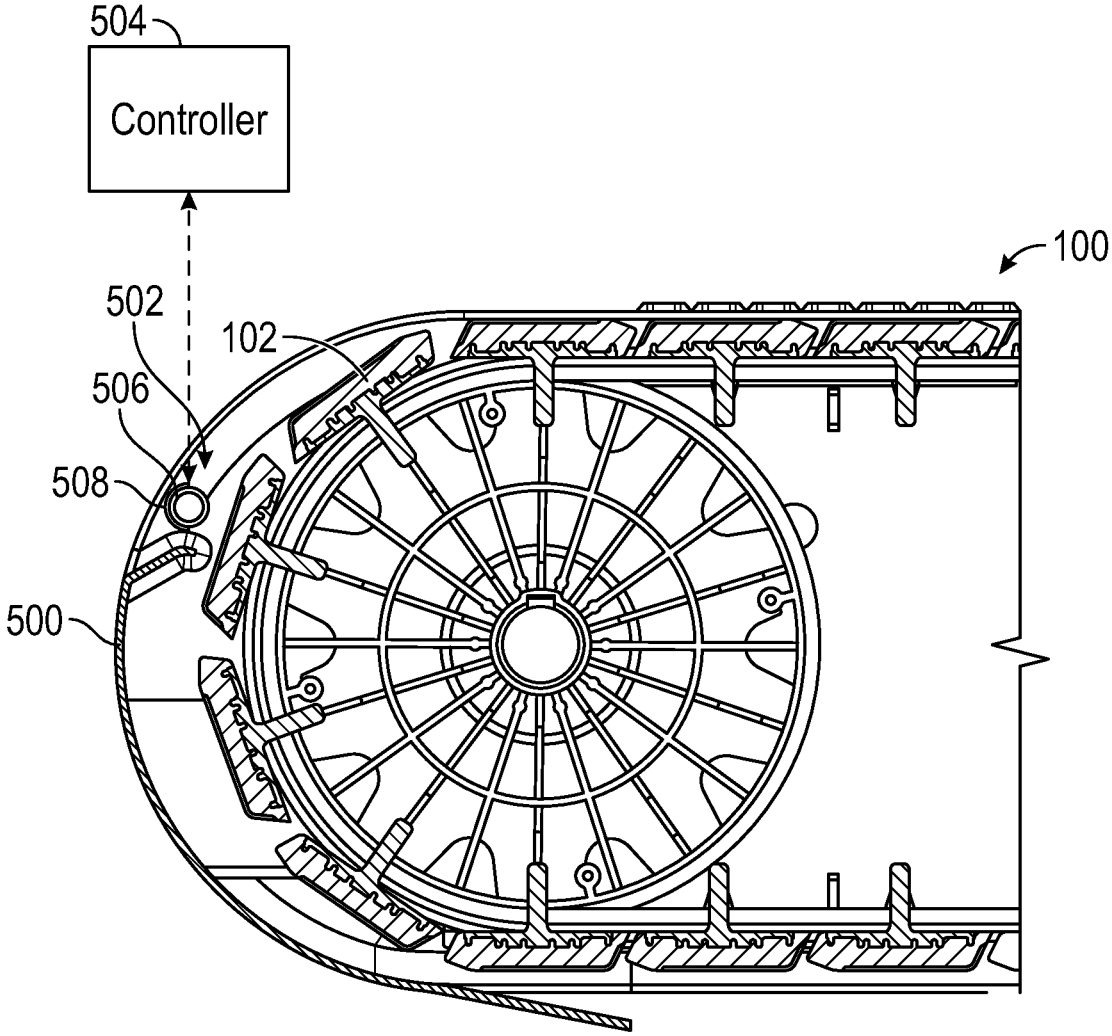

FIGS. 14-16 collectively illustrate another example embodiment of a protective cover 500 in combination with the treadmill 100. The protective cover 500 can be fastened to the side covers 116 and 118 or can have a portion that includes parts of the side covers or fixed to the structural metal frame of the treadmill 100. The protective cover 500 can be integrated with or formed integrally with the side covers 116 and 118. The protective cover 500 may include a guard sensor 502. The guard sensor 502 can comprise any one or more of a capacitance sensor, an infrared sensor, a laser distance measurement sensor (LIDAR), a proximity sensor, an ultrasonic sensor, and/or a radar sensor—just to name a few. The guard sensor 502 can include type of sensor known in the art that is capable of detecting the presence of an object. To be sure, in some embodiments, the protective cover 500 can be used without the inclusion of the guard sensor. Indeed, any of the protective covers disclosed herein can be used without an accompanying sensor or control mechanisms related to the conveyor of the treadmill.

In one embodiment, the guard sensor 502 may include a first element 506 (also referred to as first sensor element 506 or sensor 506) and a second element 508 (also referred to as second sensor element 508 or sensor 508). The first element 506 can be associated with the protective cover 500 or with one of the side cover or with the frame and the second element 508 can be associated with the protective cover 500 or with the other one of the side cover or with the frame. In another embodiment, the first element 506 can be located on a first side (e.g., left) of the conveyor 102, for example being integrated into the side cover 116. The second element 508 can be integrated into a second side (e.g., right) inside the other side cover 118. The first and second elements may be aligned with one another to ensure that signals can be emitted and received therebetween.

The first element 506 can emit a signal that is received by the second element 508 in order to determine if an object is detected in an entrapping area 501. The signal transmitted by the first element 506 and received by the second element 508 can be interrupted by an object such as a hand, finger, foot, or other object. When an object is placed between the first element and the second element, the communicative or electrical connection between the first element and the second element is interrupted, indicating that an object is inside or entrapped in the protective cover 500. In sum, the first element and the second element exchange a signal that when interrupted is indicative of the object being within the entrapping area. For example, the first element can emit a light or laser signal that is received by the second element. When this light or laser signals is interrupted, it is indicative of an object being within the entrapping area.

The protective cover 500 stops any objects that accidentally engage an entrapping area 501. The entrapping area is generally the area where the open end 503 of the treadmill 100 is covered by the protective cover 500. A gap exists between the conveyor 102 and protective cover 500 in this entrapping area. The gap may be wide enough that a hand, foot, or other object may fall therebetween. The guard sensor 502 can be used to determine when an object is in this entrapping area.

The guard sensor 502 is located near an entrapping area. When an object is detected inside this entrapping area the guard sensor 502 may cause the disengagement of a drive mechanism 512, by shutting off the power supply of the drive mechanism 512 or may activate an emergency device, such as a brake 510, and the conveyor stops. The guard sensor 502 can also cause a drive mechanism of the conveyor to stop, which results in the conveyor stopping. As with other embodiments, a controller 504 can be included to obtain sensor output and control operation of the conveyor in response thereto.

For example, the first element 506 can emit a signal that is received by the second element 508, creating a sensor signal path therebetween. When this sensor signal path is unbroken, it can be inferred that no object is within the entrapping area. When an object breaks the sensor signal path, for example when a hand or foot of a user slips between the end of the conveyor 102 and the protective cover 500, the object interrupts the sensor signal path. This interruption of signal between the first element 506 and the second element 508 is indicative of an object being in the entrapping area. When this break in signal occurs, the controller 504 can cause the conveyor 102 to stop turning. Again, this can include the engagement of an emergency brake 510 that can be applied to the conveyor 102. In alternative or in combination, this can also involve removing power from a drive mechanism 512 of the conveyor 102 such as a motor.

As with other embodiments, the controller 504 can cause a display (not shown) of the treadmill to emit a visual and/or acoustic warning when the conveyor is active and the protective cover 500 is in the open position. For example, an audible, natural language warning can be emitted by a speaker associated with the treadmill. In another example, the audible warning could be a tone or other audible sound pattern. Any of the embodiments disclosed herein can be provided with a sensor that is capable of determining when a protective cover is open/closed. A controller can be present to detect signals from the sensor and cause the conveyor of the treadmill to stop turning. Any controller disclosed herein will be understood to include at least a process and memory. In some instances, the sensor is in direct communication with an emergency device, such as a brake of the conveyor, to stop the conveyor of the treadmill based on the protective cover being open or closed (depending on the configuration of the protective cover and how it is being used).

According to the present disclosure, a treadmill 100 comprises a conveyor 102 supported on a frame 104, the conveyor 102 having an open end 503 creating an entrapping area 230 (301; 501).

The treadmill 100 further comprises a protective cover 202 (300; 402; 500) that is installed on the open end 503 of the conveyor 102 of the treadmill 100 and cover the open end 503 and prevent an object from entering the entrapping area 230 (301; 501).

According to an embodiment, the treadmill 100 further comprises a sensor 228 (311; 400; 502) associated with the treadmill 100 or the protective cover 202 (300; 402; 500), the sensor detecting when an object is near or within the entrapping area 230 (301; 501) between the protective cover 202 (300; 402; 500) and the conveyor 102 of the treadmill 100.

According to this embodiment, the treadmill 100 further comprises a controller 232 (316; 404; 504) configured to receive signals from the sensor 228 (311; 400; 502), the controller 232 (316; 404; 504) allowing the conveyor 102 to freely operate when no objects are sensed within the entrapping area 230 (301; 501) and stopping the conveyor when an object is sensed within the entrapping area 230 (301; 501).

According to a further embodiment, in combination with the previous one, the guard sensor 502 comprises a first element 506 and a second element 508, the first element 506 being disposed on a first side of the conveyor 102 and the second element 508 being disposed on a second side of the conveyor 102.

According to a further embodiment, in combination with the previous one, the first element 506 and the second element 508 exchange a signal that when interrupted is indicative of the object being within the entrapping area 501.

According to an embodiment, the controller 232 (316; 504) is configured to cause a drive mechanism 236 (320; 512) associated with the conveyor 102 to stop the conveyor 102 from turning; or cause an emergency brake 234 (318; 510) associated with the conveyor 102 to engage and stop the conveyor 102 from turning.

According to an embodiment, in combination with any one of previous embodiments, the frame 104 further comprises side covers 116, 118 that enclose edges of the conveyor 102.

In this embodiment, the protective cover 202 (300; 402; 500) is configured to engaged with one or more of the side covers 116, 118.

According to an embodiment, in combination with the previous one, the protective cover 202 (300) comprises an arcuate body 208 (302) that is configured to cover a portion of the open end 503 of the conveyor 102.

In this embodiment, the arcuate body 208 (302) is hingedly coupled to the frame 104 of the treadmill 100 using brackets 108, 110 (304, 306) installed on the treadmill.

According to the present disclosure, a system comprises a protective cover 202 (300; 402; 500) for a treadmill 100.

The system further comprises a first sensor element 506 associated with the protective cover 500.

The system further comprises a second sensor element 508 associated with a side cover 116, 118 of the treadmill 100.

The system further comprises a controller 232 (316; 404; 504) configured to receive signals from the first sensor element 506 and the second sensor element 508.

The controller 232 (316; 404; 504) allows a conveyor 102 of the treadmill 100 to freely operate when the signals from the first sensor element 506 and the second sensor element 508 indicate that the protective cover 500 is closed, and stopping the conveyor 102 when the signals from the first sensor element 506 and the second sensor element 508 indicate that the protective cover 500 is open.

According to an embodiment, the controller 232 (316; 504) is configured to cause a drive mechanism 236 (320; 512) associated with the conveyor 102 to stop the conveyor 102 from turning.

According to a further embodiment, the controller 232 (316; 504) is configured to cause an emergency brake associated with the conveyor 102 to engage and stop the conveyor 102 from turning.

According to a further embodiment, the protective cover 202 (300) comprises an arcuate body 208 (302) that is configured to cover an open end 503 of the conveyor 102.

In this embodiment, the arcuate body 208 (302) is hingedly coupled to a frame 104 of the treadmill 100 using brackets 108, 110 (304, 306) installed on the treadmill 100.

According to a further embodiment, the protective cover 202 (300; 402; 500) is configured to be installed on an open end 503 of a conveyor 102 of a treadmill 100.

According to a further embodiment, the protective cover 202 (300; 402; 500) comprises a tab 310 engaging with a side cover 116, 118 of the treadmill 100, the first sensor element 506 being associated with the tab 310.

According to a further embodiment, the second sensor element 508 is associated with the side cover 116, 118 of the treadmill 100.

According to the present disclosure, a device comprises an arcuate body 208 (302) for a treadmill 100.

The device comprises a first armature extending from the arcuate body 208 (302).

The device comprises a second armature extending from the arcuate body 208 (302) in parallel with the first armature.

The device comprises a first coupling interface 218 on a terminal end of the first armature.

The device comprises a second coupling interface 220 on a terminal end of the second armature, the first coupling interface 218 and the second coupling interface 220 being associated with legacy brackets 108, 110 of a frame 104 of the treadmill 100.

According to an embodiment, in combination with the previous one, the first coupling interface 218 comprises a coupler body having a hook portion extending therefrom, the coupler body mating with a first legacy bracket of the legacy brackets, the hook portion engaging with a j-shaped pin of the first legacy bracket.

According to a further embodiment, the second coupling interface comprises a coupler body 222 having a hook portion 224 extending therefrom, the coupler body 222 mating with a second legacy bracket 110 of the legacy brackets, the hook portion 224 engaging with a j-shaped pin 114 of the second legacy bracket 108.

According to a further embodiment, the arcuate body 208 (302) is configured to be installed on an open end 503 of a conveyor 102 of a treadmill 100.

According to a further embodiment, in combination with any of the previously described embodiments, the device further comprises a controller 232 (316; 404; 504) and a sensor 506, 508.

In this embodiment, the sensor 506, 508 is configured to detect presence of an object in an entrapping area 230 (301; 501) between the arcuate body 208 (302) and the conveyor 102.

According to an embodiment, in combination with the previous one, the controller 232 (316; 504) is configured to cause a drive mechanism 236 (320; 512) associated with the conveyor 102 to stop the conveyor 102 from turning when the sensor 506, 508 has detected the presence of the object; or cause an emergency brake 234 (318; 510) associated with the conveyor 102 to engage and stop the conveyor 102 from turning when the sensor 506, 508 has detected the presence of the object.

Figure 17:
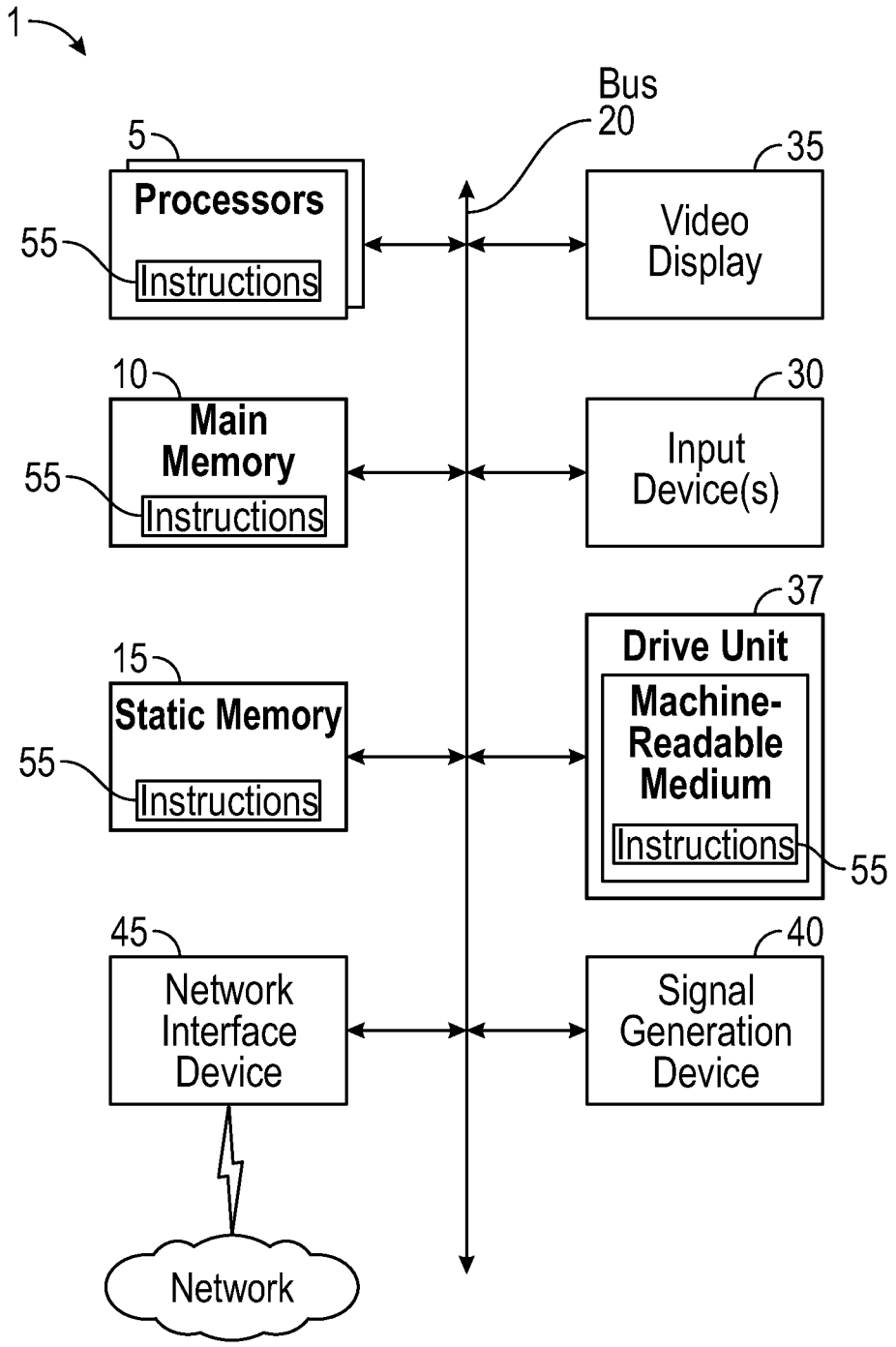
FIG. 17 is a schematic diagram of an example computer device for practicing aspects of the present disclosure.

FIG. 17 is a diagrammatic representation of an example machine in the form of a computer system 1, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a portable music player (e.g., a portable hard drive audio device such as a Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The computer system 1 includes a processor or multiple processor(s) 5 (e.g., a central processing unit (CPU), a graphics processing unit (GPU), or both), and a main memory 10 and static memory 15, which communicate with each other via a bus 20. The computer system 1 may further include a video display 35 (e.g., a liquid crystal display (LCD)). The computer system 1 may also include an alphanumeric input device(s) 30 (e.g., a keyboard), a cursor control device (e.g., a mouse), a voice recognition or biometric verification unit (not shown), a drive unit 37 (also referred to as disk drive unit), a signal generation device 40 (e.g., a speaker), and a network interface device 45. The computer system 1 may further include a data encryption module (not shown) to encrypt data.

The drive unit 37 includes a computer or machine-readable medium 50 on which is stored one or more sets of instructions and data structures (e.g., instructions 55) embodying or utilizing any one or more of the methodologies or functions described herein. The instructions 55 may also reside, completely or at least partially, within the main memory 10 and/or within the processor(s) 5 during execution thereof by the computer system 1. The main memory 10 and the processor(s) 5 may also constitute machine-readable media.

The instructions 55 may further be transmitted or received over a network via the network interface device 45 utilizing any one of a number of well-known transfer protocols (e.g., Hyper Text Transfer Protocol (HTTP)). While the machine-readable medium 50 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

The components provided in the computer system 1 are those typically found in computer systems that may be suitable for use with embodiments of the present disclosure and are intended to represent a broad category of such computer components that are well known in the art. Thus, the computer system 1 can be a personal computer (PC), hand held computer system, telephone, mobile computer system, workstation, tablet, phablet, mobile phone, server, minicomputer, mainframe computer, wearable, or any other computer system. The computer may also include different bus configurations, networked platforms, multi-processor platforms, and the like. Various operating systems may be used including UNIX, LINUX, WINDOWS, MAC OS, PALM OS, QNX ANDROID, IOS, CHROME, TIZEN, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

In some embodiments, the computer system 1 may be implemented as a cloud-based computing environment, such as a virtual machine operating within a computing cloud. In other embodiments, the computer system 1 may itself include a cloud-based computing environment, where the functionalities of the computer system 1 are executed in a distributed fashion. Thus, the computer system 1, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud is formed, for example, by a network of web servers that comprise a plurality of computing devices, such as the computer system 1, with each server (or at least a plurality thereof) providing processor and/or storage resources. These servers manage workloads provided by multiple users (e.g., cloud resource customers or other users). Typically, each user places workload demands upon the cloud that vary in real-time, sometimes dramatically. The nature and extent of these variations typically depends on the type of business associated with the user.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASHEPROM, any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present technology may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The foregoing detailed description includes references to the accompanying drawings, which form a part of the detailed description. The drawings show illustrations in accordance with exemplary embodiments. These example embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A treadmill, comprising:

a conveyor supported on a frame, the conveyor having an open end;

a protective cover that is installed on the open end of the conveyor of the treadmill to cover the open end and provide protection from an object entering an entrapping area; and a sensor associated with the protective cover, the sensor detecting when the object is within the entrapping area between the protective cover and the conveyor of the treadmill.

2. The treadmill according to claim 1, further comprising:

a controller configured to receive signals from the sensor, the controller allowing the conveyor to freely operate when no objects are sensed within the entrapping area and stopping the conveyor when the object is sensed within the entrapping area.

3. The treadmill according to claim 2, wherein the sensor comprises a first element and a second element, the first element being disposed on a first side of the conveyor and the second element being disposed on a second side of the conveyor.

4. The treadmill according to claim 3, wherein the first element and the second element exchange a signal that when interrupted is indicative of the object being within the entrapping area.

5. The treadmill according to claim 2, wherein the controller is configured to cause a drive mechanism associated with the conveyor to stop the conveyor from turning; or cause an emergency brake associated with the conveyor to engage and stop the conveyor from turning.

6. The treadmill according to claim 2, wherein the controller is configured to remove power from a drive mechanism associated with the conveyor when the sensor has detected a presence of the object.

7. The treadmill according to claim 1, wherein the frame further comprises side covers that enclose edges of the conveyor, the protective cover being configured to engage with one or more of the side covers.

8. The treadmill according to claim 7, wherein the protective cover comprises an arcuate body that is configured to cover a portion of the open end of the conveyor, the arcuate body being hingedly coupled to the frame of the treadmill using brackets installed on the treadmill.

9. A system comprising:

a protective cover for a treadmill;

a first sensor element associated with the protective cover;

a second sensor element associated with a side cover of the treadmill; and a controller configured to receive signals from the first sensor element and the second sensor element, the controller allowing a conveyor of the treadmill to freely operate when the signals from the first sensor element and the second sensor element indicate that the protective cover is closed, and stopping the conveyor when the signals from the first sensor element and the second sensor element indicate that the protective cover is open.

10. The system according to claim 9, wherein the controller is configured to cause a drive mechanism associated with the conveyor to stop the conveyor from turning.

11. The system according to claim 9, wherein the controller is configured to cause an emergency brake associated with the conveyor to engage and stop the conveyor from turning.

12. The system according to claim 9, wherein the protective cover comprises an arcuate body that is configured to cover an open end of the conveyor, the arcuate body being hingedly coupled to a frame of the treadmill using brackets installed on the treadmill.

13. The system according to claim 9, wherein the protective cover is configured to be installed on an open end of the conveyor of the treadmill.

14. The system according to claim 9, wherein the protective cover comprises a tab that engages with the side cover of the treadmill, the first sensor element being associated with the tab.

15. A device comprising:

an arcuate body for a treadmill;

a first armature extending from the arcuate body;

a second armature extending from the arcuate body in parallel with the first armature;

a first coupling interface on a terminal end of the first armature, the first coupling interface being associated with a first legacy bracket associated with a frame of the treadmill, the first coupling interface comprising a coupler body having a hook portion extending therefrom, the coupler body mating with the first legacy bracket, the hook portion engaging with a j-shaped pin of the first legacy bracket; and a second coupling interface on a terminal end of the second armature, the second coupling interface being associated with a second legacy bracket associated with the frame of the treadmill.

16. The device according to claim 15, wherein the second coupling interface comprises a coupler body having a hook portion extending therefrom, the coupler body mating with the second legacy bracket of the legacy brackets, the hook portion engaging with a j-shaped pin of the second legacy bracket.

17. The device according to claim 15, wherein the arcuate body is configured to be installed on an open end of a conveyor of the treadmill.

18. The device according to claim 17, further comprising a controller and a sensor, the sensor being configured to detect a presence of an object in an entrapping area between the arcuate body and the conveyor.

19. The device according to claim 18, wherein the controller is configured to:

cause a drive mechanism associated with the conveyor to stop the conveyor from turning when the sensor has detected the presence of the object; or cause an emergency brake associated with the conveyor to engage and stop the conveyor from turning when the sensor has detected the presence of the object.

20. The device according to claim 18, wherein the controller is configured to remove power from a drive mechanism associated with the conveyor when the sensor has detected the presence of the object.

* * * * *